US005526766A

United States Patent [19]

Armstrong et al.

[11] Patent Number: 5,526,766

[45] Date of Patent: Jun. 18, 1996

[54] HULL MARKINGS

[75] Inventors: Jerry S. Armstrong, Yorktown; Jerome E. Blair, III, Suffolk; Jean S. Pugh, Newport News; Allan G. Roy, Yorktown; David R. Sawyer, Smithfield; Steven D. Tassias, Newport News; Rex A. Wallen, Hampton, all of Va.

[73] Assignee: Newport News Shipbuilding and Dry Dock Company, Newport News, Va.

[21] Appl. No.: 345,537

[22] Filed: Nov. 28, 1994

Related U.S. Application Data

[63] Continuation of Ser. No. 46,786, Apr. 13, 1993, abandoned.

[51] Int. Cl.[6] ..... B63B 35/00

[52] U.S. Cl. ..... 114/343; 411/171

[58] Field of Search ..... 114/343, 364, 114/219, 270, 65 R, 67 R; 219/98, 99; 40/596, 616; 434/113; 411/171, 258

[56] References Cited

U.S. PATENT DOCUMENTS

| | | | |
|---|---|---|---|
| 2,477,765 | 8/1949 | Nelson | 219/99 |
| 2,784,014 | 3/1957 | Kelemen | 219/99 |
| 2,885,531 | 5/1959 | Aversten | 219/99 |
| 2,898,443 | 8/1959 | Havemeyer | 219/99 |
| 3,058,086 | 10/1962 | Zwanzig | 204/196 |
| 3,299,248 | 1/1967 | Meyer | 219/98 |
| 3,625,851 | 12/1971 | Geld | 204/196 |
| 3,776,574 | 12/1973 | Henderson et al. | 283/1 |
| 3,987,568 | 10/1976 | Rosenberg | 40/140 |
| 4,130,751 | 12/1978 | Gordon | 219/98 |
| 4,547,985 | 10/1985 | Silins et al. | 219/98 |
| 4,628,855 | 12/1986 | Nishida | 114/364 |
| 5,048,445 | 9/1991 | Lever et al. | 114/222 |
| 5,067,426 | 11/1991 | Vespoli et al. | 114/56 |
| 5,101,750 | 4/1992 | Dumas | 114/74 R |
| 5,217,319 | 6/1993 | Klohn | 434/113 |

FOREIGN PATENT DOCUMENTS

| | | | |
|---|---|---|---|
| 193470 | 2/1923 | United Kingdom | 434/113 |

OTHER PUBLICATIONS

Nelson Stud Welding 1955 Annual Handbook.
Nelson Concave Stud Publication Mar. 1974.

*Primary Examiner*—Edwin L. Swinehart
*Attorney, Agent, or Firm*—Lalos & Keegan

[57] ABSTRACT

A method of making a marine indicia marking on the surface of a steel hull, and the product produced thereby. The method comprises establishing a preconceived pattern for the marking and welding a plurality of nipples to the outside of the hull conforming to the pattern. Preferably, stud arc welding is used to weld the nipples to the hull. The stud used in the stud arc weld gun is of the knock-off variety and includes an upper knock-off portion and a lower permanent stud. After installation, the surface of the stud may be made smooth by grinding or other suitable methods. Finally, the studs and adjacent portions of the hull surface are painted with contrasting color paint.

9 Claims, 1 Drawing Sheet

HULL MARKINGS

This is a continuation of application(s) Ser. No. 08/046,786 filed on Apr. 13, 1993, now abandoned.

FIELD OF THE INVENTION

This invention relates to a method of making a marine permanently visible indicia marking on the hull of a ship to convey information about the ship. The invention also relates to a permanently visible marine indicia on the surface of a ship's hull.

BACKGROUND OF THE INVENTION

A number of hull marine indicia markings, such as Plimsoll lines, draft markings, ship's name and port designation are required by law. Additional hull markings are often desired. For instance, it is advantageous to visibly convey such information as the location of various discharge valves, fuel lines, tank locations, corners of tanks, bulkhead frames, sea chests, and hull sections to be marked to facilitate underwater inspections and surveys.

Typically, a raised weld bead is used to create the marking, whereupon the marking is painted using the weld bead as a guide. However, providing these weld beads is a labor intensive process, particularly when the marking is located on the exterior side of a fuel oil, lube oil, oily sludge, natural gas chemicals or similar products. Conformance with shipbuilding specifications requires that a special hot work permit be obtained prior to welding opposite a tank. To obtain a hot work permit, the tank may have to be emptied completely, cleaned, or have the level of its contents changed, and determined to be purged of oxygen prior to beginning the welding process. Thus, this method is undesirable for many reasons.

Another prior art method for marking a hull involves center punches and painting over the punches. These center punches, however, are easily lost whenever the hull is blasted before painting.

SUMMARY OF THE INVENTION

The invention uses stud arc welding to create permanently visible hull marine indicia as a cost effective alternative to weld beads. The marking is formed by positioning and welding a number of welding studs such that their spatial configuration conforms to the pattern of generally accepted marine indicia used for conveying ship specific information. After installation, the surface of the stud may be made smooth by grinding or other suitable methods to provide a smooth, rounder surface for accepting and enhancing the adherence of paint. Finally, the studs and the portion of the ship's hull which conforms with the indicia pattern indicated by the studs is painted so as to form a distinct contrast with the remainder of the hull for better visibility.

DETAILED DESCRIPTION

Figure 1:
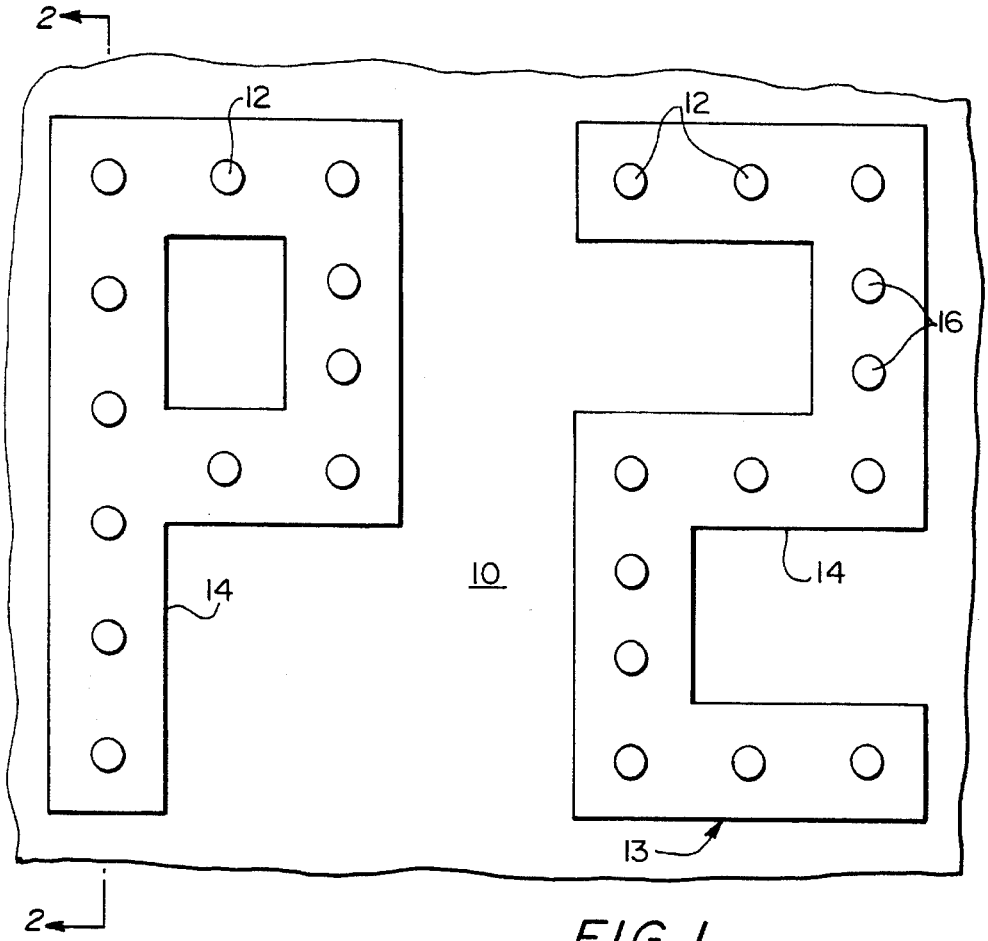
FIG. 1 is a side view of a preferred embodiment of the present invention.
Figure 2:
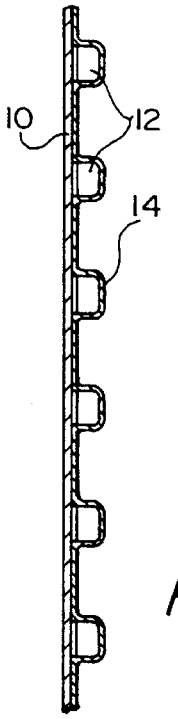
FIG. 2 is a sectional view taken along line 2—2 of FIG. 1.

Referring to the drawings, and particularly to FIG. 1, a steel hull of a ship is shown as 10. A plurality of nipples 12 is welded to hull 10 in a closely spaced predetermined mutual spatial relationship to form a preconceived pattern 13 conforming to a marine indicia. As shown in FIG. 1, nipples 12 are placed with approximately ¾" to 1¼" between centers and form the marking "P2" indicating hull penetration on the port side numbered consecutively from bow to stern. Referring to FIG. 2, it can be seen that nipples 12 project outwardly from the surface of the hull. Disposed on studs 12 and a portion of hull 10 adjacent nipples 12 is a layer of paint 14.

Nipples 12 may be either hand welded to hull 10 or welded using a stud arc weld gun. To quickly and efficiently weld the nipples to the hull, the stud arc weld gun method is preferred. If the gun is used, a stud 15 is required.

Figure 3:
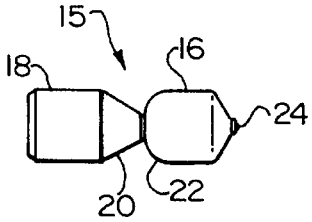
FIG. 3 is a detail view of a stud of the embodiment of FIGS. 1 and 2.

The details of stud 15 are shown in FIG. 3. To minimize the height of the installed stud, the stud is preferably of the knock-off variety. A knock-off stud permits the installation of a stud which is of a length less than the minimum length required for a stud arc gun. This type of stud includes a permanent stud 16 forming nipple 12 and an upper portion 18. After installation, upper portion 18 is removed from permanent stud 16. To facilitate removal of the knock-off, upper portion 18 includes a taper 20 at the end thereof adjacent to permanent stud 16. Preferably, permanent stud 16 includes a rounded surface 22 to improve adherence of paint 14. Furthermore, permanent stud 16 includes an aluminum ball 24 at the tip thereof. Aluminum ball 24 is used to initiate the arc required for the welding process. It is preferred that the stud be approximately 5/16" in diameter and of a length before knock-off of approximately ⅞". The length of the permanent stud is preferably approximately ⅜". The diameter and length of the stud are not critical and may vary considerably from the foregoing if desired.

The studs are installed using conventional stud arc welding, an arc welding process which produces coalescence of metals by heating them with an arc between the metal stud 15 and the work part, in this instance, the hull 10. When the surfaces to be joined are properly heated, they are brought together under pressure with a conventional stud welding gun. A ceramic ferrule is used to surround the stud, contain the molten metal and shield the arc.

The heat necessary for welding the studs is developed by a dc arc between stud 15 (electrode) and hull 10 (work) to which the stud is to be welded. The conventional stud welding gun is used to hold the studs and move them in proper sequence during welding. The operator positions the gun including the stud and actuates the unit by pressing a switch. The weld is completed quickly, usually in less than one second. The time required for installation typically decreases with the decreasing diameter of the stud.

An advantage of the method of the present invention is that the studs can be welded at any appropriate time during construction since access to the inside of the hull is not required. Additionally, the stud welding process minimizes distortion to the surface of the hull, thus improving the reliability of the ship against leakage. A further advantage of the method of the present invention is that the raised stud facilitates surveys in murkier waters, where the diver can feel the markings.

From the foregoing detailed description, it will be evident that there are a number of changes, adaptations and modifications of the present invention which come within the province of those having ordinary skill in the art to which the aforementioned invention pertains. However, it is intended that all such variations not departing from the spirit of the invention be considered as within the scope thereof, limited solely by the appended claims.

We claim:

1. A method of making a marine indicia on the outside of the steel hull of a ship consisting essentially of:

(a) establishing a preconceived pattern for said marine indicia;

(b) welding a plurality of nipples to protrude and be visible their entire length from the outside of the hull conforming to said preconceived pattern to form the marine indicia;

(c) maintaining the visibility of said nipples their entire length outside said hull.

2. A method of making a indicia on a steel hull of a ship consisting essentially of:

(a) establishing a preconceived pattern for said marine indicia;

(b) positioning a stud weld gun adjacent to the hull so that the end of the gun contacts the surface of the hull;

(c) heating a small portion of the steel hull surface with an electric arc passing between the stud and the hull;

(d) melting the small portion of the hull surface;

(e) securing a stud,having a smooth continuous cylindrical surface the entire length thereof and rounded end forming a smooth curve, to the melted portion of the hull;

(f) repeating steps (b) through (e) for a plurality of studs conforming to said pattern to form the marine indicia on said hull;

(g) painting the plurality of studs and a portion of the hull surface adjacent the plurality of studs.

3. A method according to claim 2, including providing each of the plurality of studs with a knock-off upper portion and a lower permanent nipple, wherein the step of securing a stud to the melted portion of the hull comprises:

shearing each of the upper portions from each of the permanent nipples.

4. A method according to claim 3, wherein the step of securing a stud to the melted portion of the hull further comprises the step of:

grinding each of the ends of the permanent nipples to provide a smooth, surface.

5. A method according to claim 3, wherein the step of painting includes:

painting the plurality of permanent nipples and a portion of the hull surface adjacent said permanent nipples.

6. A vessel hull marine indicia in a preconceived pattern comprising:

a plurality of nipples having a continuous cylindrical surface the entire length thereof welded to the surface of a steel hull in a closely spaced predetermined spatial mutual relationship to form the marine indicia, the plurality of nipples projecting from the hull surface so as to be permanently visible substantially their entire length.

7. A marking according to claim 6, wherein the preconceived pattern includes the plurality of studs and a portion of the hull surface adjacent the plurality of nipples, the marking further comprising a layer of paint covering the preconceived pattern.

8. An marking according to claim 6, wherein each of said plurality of nipples includes a stud having a rounded, upper surface.

9. A method of making a marine indicia on the outside of the steel hull of a ship consisting essentially of:

(a) establishing a preconceived pattern for said marine indicia;

(b) welding a plurality of nipples, having a smooth continuous cylindrical surface and a rounded end forming a smooth curve, to the outside of the hull to project from said hull surface so as to be permanently visible substantially their entire length and conforming to said preconceived pattern to form the marine indicia;

(c) maintaining the visibility of said nipples their entire length outside said hull, (d) painting the plurality of nipples and a portion of the hull surface adjacent the plurality of nipples.

* * * * *